US006572342B2

(12) United States Patent
Ahn et al.

(10) Patent No.: US 6,572,342 B2
(45) Date of Patent: Jun. 3, 2003

(54) VARIABLE CAPACITY COMPRESSOR AND METHOD OF MANUFACTURING

(75) Inventors: Hew-nam Ahn, Daejeon (KR); Tae-young Park, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 0 days.

(21) Appl. No.: 09/977,209

(22) Filed: Oct. 16, 2001

(65) Prior Publication Data

US 2002/0141880 A1 Oct. 3, 2002

(30) Foreign Application Priority Data

Feb. 16, 2001 (KR) ..... 2001-7892

(51) Int. Cl.[7] ..... F04B 1/26; F04B 1/12; F01B 3/00; B23P 15/00

(52) U.S. Cl. ..... 417/222.1; 417/53; 417/222.2; 417/269; 92/71; 29/888.02

(58) Field of Search ..... 417/222.1, 222.2, 417/269, 53; 92/71; 29/888.02, 888.021

(56) References Cited

U.S. PATENT DOCUMENTS 4,846,049 A 7/1989 Terauchi
5,125,803 A 6/1992 Terauchi
5,644,968 A * 7/1997 Kimura et al. ..... 92/12.2
5,699,716 A 12/1997 Ota et al.
5,722,310 A * 3/1998 Ota et al. ..... 92/12.2

FOREIGN PATENT DOCUMENTS

JP 11-257216 * 9/1999 ..... F04B/27/08

* cited by examiner

*Primary Examiner*—Charles G. Freay
*Assistant Examiner*—Timothy P. Solak
(74) *Attorney, Agent, or Firm*—Leydig, Voit & Mayer, Ltd.

(57) ABSTRACT

An easy method for manufacturing a swash plate and a variable capacity swash plate compressor adopting the swash plate are provided. The method for manufacturing a swash plate or a hub having a boss including a through hole includes: holding a swash plate or a hub at a maximum inclination angle with respect to an horizontal axis; calculating a diameter DH of the through hole using the relation DS<DH<(DS/cos α)+1.0 mm, where DS is the diameter in millimeters of a drive shaft to be mounted passing through the through hole, and α is the maximum inclination angle of the swash plate; and forming the through hole to have the diameter calculated in through a single process on the swash plate or the hub in a maximum inclination angle position, resulting in the boss of the swash plate or the hub, the single process being carried out in a horizontal direction.

13 Claims, 10 Drawing Sheets

VARIABLE CAPACITY COMPRESSOR AND METHOD OF MANUFACTURING

BACKGROUND OF THE INVENTION

1. Field of the Invention

The present invention relates to a compressor and a method for manufacturing the same, and more particularly, to an easy method for manufacturing a swash plate and a variable capacity swash plate type compressor adopting the swash plate.

2. Description of the Related Art

In general, a compressor for use in an air conditioner for a vehicle pumps a heat exchange medium (refrigerant) in an evaporator by suctioning, compressing, and discharging a vaporized heat exchange medium.

A variety of compressors, such as swash plate, scroll, rotary, wobble plate, etc., which are classified according to the compression and driving methods, are available. The capacity of such compressors is fixed in the manufacture thereof. Thus, when such a compressor is used in an air conditioner for a vehicle operated by an engine, the load on the engine increases as the compressor operates because pumping capacity of the compressor cannot be varied in response to a cooling load.

To solve this problem, a variable capacity compressor having discharge capacity variable in response to the cooling load of the air conditioner has been suggested. An example of the variable capacity compressor is shown in FIG. 1. Referring to FIG. 1, a variable capacity swash plate type compressor includes a cylinder block 12 provided with a plurality of bores 11, a housing 13 combined with the cylinder block 12 to form a crank chamber 22 therein, a drive shaft 16 rotatably supported by the housing 13 and the cylinder block 12, a rotor or lug plate 17 mounted on the drive shaft 13 to be rotatable along with the drive shaft 16, and a swash plate 18. The swash plate 18 is hinged to the rotor 17 fixed on the drive shaft 16 by a hinge unit 19, and has a through hole 18*a* at the center through which the drive shaft 16 passes. Pistons 20 are disposed in each of the bores 11 and are engaged with the swash plate 18 via semi-spherical shoes 21.

The variable capacity swash plate type compressor having the structure described above pumps a compressed medium (refrigerant gas) by converting rotations of the rotor 17 and the swash plate 18, which rotates with the drive shaft 16, into reciprocation of the pistons 20. Here, the pumping rate of the variable capacity swash plate type compressor is varied depending on pumping load by adjusting the stroke of the pistons 20 with the swash plate 18 which is hinged to the rotor 17 and rotates at a predetermined inclination angle with respect to the rotor 17.

When the variable capacity swash plate type compressor is operated as described above, the swash plate 18 rotating together with the rotor 17 should be slidably guided along the drive shaft 16 through the through hole 18*a* formed at the center of the swash plate 18.

U.S. Pat. No. 5,699,716 discloses a swash plate having a through hole including first and second conical inner surfaces sloping inwards from each surface of the swash plate. In U.S. Pat. No. 5,125,803, a through hole in a cylindrical member has circular and conical inner surfaces to prevent undesired contact between the drive shaft and the cylindrical member during rotation of the cylindrical member. U.S. Pat. No. 4,846,049 discloses a cylindrical member having a hole with upper and lower planar surfaces having different angles relative to the central axis of the cylindrical member.

To form the through holes described above, the shapes of which are designed enable the swash plate or the cylindrical member to be displaced at both minimum and maximum inclination angles, at least two drillings and a single reaming are needed, thereby complicating the manufacture of the through hole with low productivity.

SUMMARY OF THE INVENTION

To solve the above-described problems, it is a first object of the present invention to provide a method for manufacturing a swash plate in which a through hole enabling the swash plate to be displaced at both maximum and minimum inclination angles without interference with a drive shaft is formed through a single process with improved productivity.

It is a second object of the present invention to provide a method for manufacturing a variable capacity swash plate type compressor with the swash plate.

To achieve the first object of the present invention, there is provided a method for manufacturing a swash plate or a hub having a boss formed by a through hole, the method comprising: (a) holding a swash plate or a hub in which a through hole is to be formed at a maximum inclination angle with respect to an horizontal axis; (b) calculating a diameter DH of the through hole using the relation $DS<DH\leqq(DS/\cos\alpha)+1.0$ mm, where DS is the diameter in millimeters of a drive shaft to be mounted passing through the through hole, and a is the maximum inclination angle of the swash plate; and (c) forming the through hole to have the diameter calculated in step (b) through a single process on the swash plate or the hub in a maximum inclination angle position, resulting in the boss of the swash plate or the hub, the single process being carried out in a direction parallel to the horizontal axis.

In step (c), it is preferable that the through hole is formed in a portion offset by a predetermined distance from the center of the swash plate or the hub.

It is preferable that step (b) comprises calculating a thickness (t) of the boss of the swash plate or the hub using the relation $t\leqq2(a-r)/\tan\alpha$, where a is the major axis in millimeters of elliptical openings of the through hole, and r is the radius in millimeters of the drive shaft.

To achieve the second object of the present invention, there is provided a variable capacity swash plate type compressor comprising: a cylinder block provided with a plurality of bores; front and rear housings combined with each other while the cylinder block is interposed therebetween to form a crank chamber and suction and discharge chambers; a drive shaft rotatably supported by the front and rear housings; a plurality of pistons reciprocally disposed in each of the bores of the cylinder block; a rotor fixedly mounted on the drive shaft to be rotatable with the drive shaft in the crank chamber; and a swash plate having a through hole and being hinged to the rotor by a hinge unit for reciprocating the plurality of pistons, the through hole through which the drive shaft passes, being formed through a single process to have a diameter DH satisfying the relation $DS<DH\leqq(DS/\cos\alpha)+1.0$ mm, where DS is the diameter of the drive shaft in millimeters, and $\alpha$ is the maximum inclination angle of the swash plate.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

A method for manufacturing a swash plate for a variable capacity compressor according to the present invention relates to formation of a through hole, through which a drive shaft passes, in a swash plate or a hub coupled to the swash plate which rotates while being hinged to a rotor fixedly mounted on a drive shaft of the variable capacity compressor, through which the drive shaft passes. A preferred embodiment of the swash plate manufacturing method will be described with reference to FIGS. 2 through 5.

Figure 6:
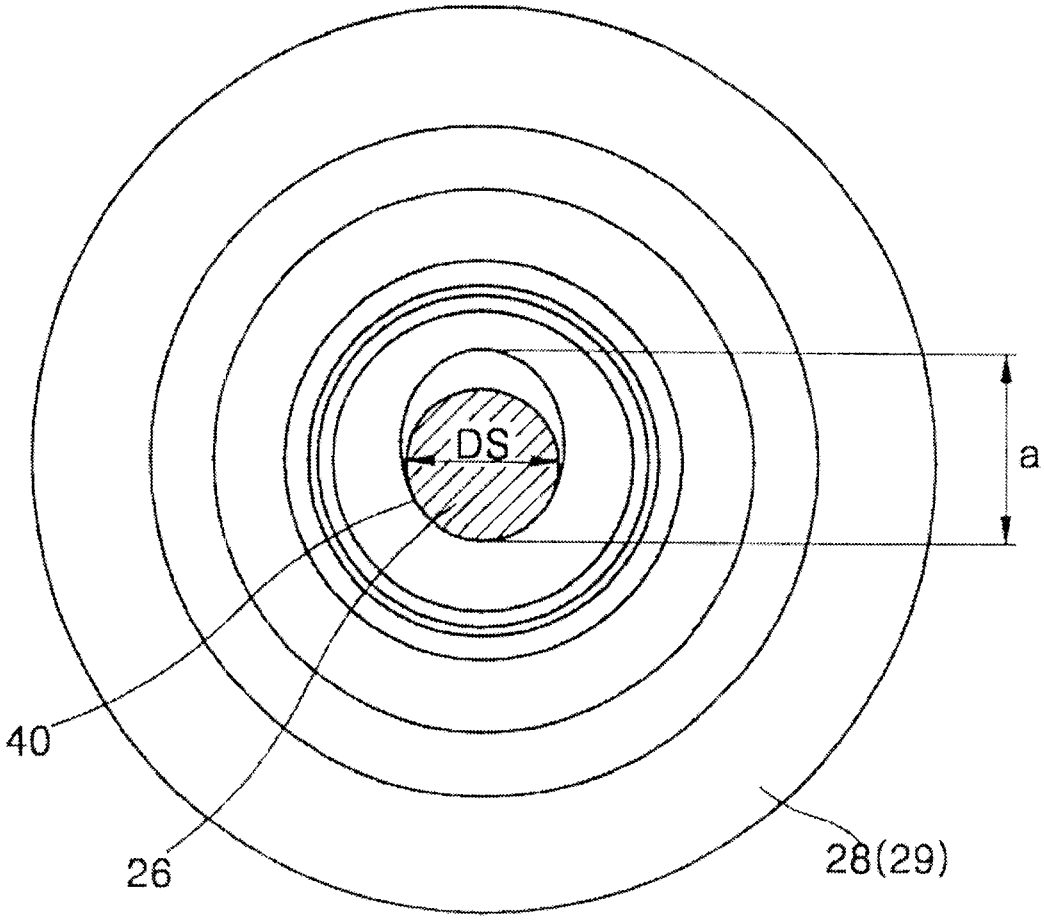
FIG. 6 is a front view of a swash plate or a hub in a maximum inclination angle position in which a drive shaft disposed in a through hole is shown.

A swash plate 28 or a hub 29 in which a through hole 40 is to be formed is prepared and supported at a maximum inclination angle $\alpha$ with respect to the horizontal axis (Step 1). Next, a diameter DH of the through hole 40 to be formed at the center of the swash plate 28 or the hub 29 is calculated (Step 2). In Step 2, the diameter DH of the through hole 40 is determined by considering the diameter of the drive shaft 26, interference with the drive shaft 26 with respect to variations in maximum and minimum inclination angles of the swash plate 28, and offset of the centroid of the swash plate 28 during rotation. In particular, because the swash plate 29 is rotated along with the drive shaft 26 which is horizontally supported, while being hinged to a rotor (not shown), the size of the through hole 40 should be determined such that the drive shaft 20 is slidably inserted into the through hole 40, enabling the swash plate 19 to be displaced at both maximum and minimum displacements. In other words, for smooth displacement of the swash plate 28 at its maximum inclination angle, the through hole 40 formed in the swash plate 28 or the hub 29, which is manufactured by processing the swash plate 28 or the hub 29 in the maximum inclination angle position in a direction parallel to the drive shaft 26, has elliptical openings, as shown in FIG. 6. Thus, it is preferable that the drive shaft 26 which is horizontally supported is enclosed by the elliptical openings of the swash plate 28 in the maximum inclination angle position.

By considering the above condition in which the drive shaft 26 needs to be enclosed by the elliptical openings of the swash plate 28 or the hub 29, the present inventors have established a predetermined relation with which the diameter DH of the through hole 40 to be formed in the swash plate 28 or the boss 29 is calculated: $DS<DH<(DS/\cos\alpha)+1.0$ mm, where DS is the diameter of the drive shaft 26, and $\alpha$ is the maximum inclination angle of the swash plate 28. Here, by considering possible interference with the outer surface of the drive shaft 26, the maximum limit of the diameter DH has an allowance of 0.1 mm, but the allowance may be in the range of 0.4–1.2 mm, preferably, 0.5 mm.

Figure 7:
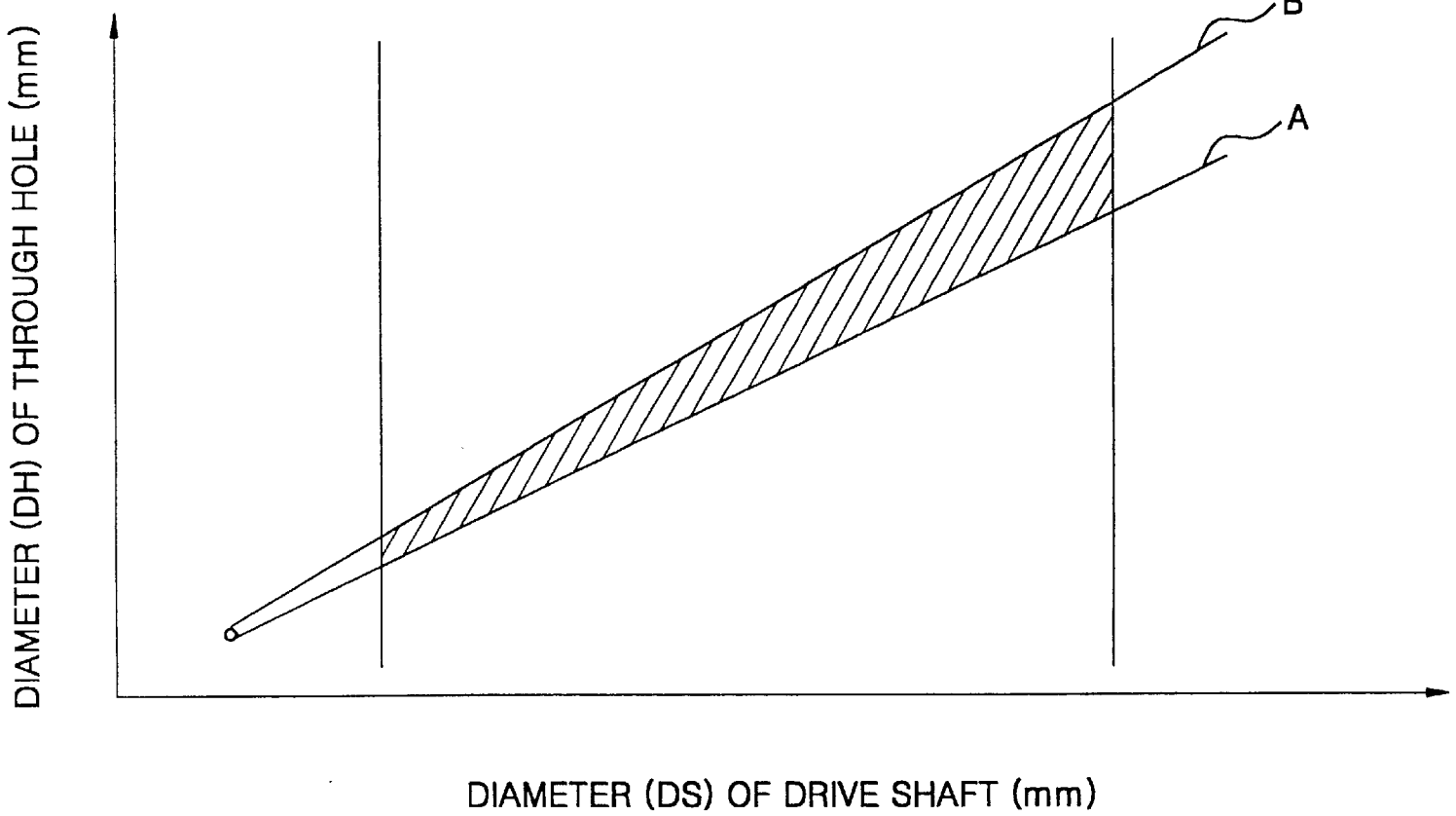
FIG. 7 is a graph illustrating the relation between the diameter of the drive shaft and the diameter of the through hole.

In particular, the present inventor has investigated the relation of the diameter (DS) of the drive shaft 26 to the diameter (DH) of the through hole 40 by varying the maximum inclination angle of the swash plate 28 in the range of 15–30°. The result is shown in FIG. 7. In FIG. 7, graph A denotes an allowable range of the minimum diameter of the through hole 40 at the maximum inclination angle obtained with the relation above by varying the diameter (DS) of the drive shaft 26. Graph B denotes an allowable range of the maximum diameter of the through hole 40 at the maximum inclination angle obtained with the relation above by varying the diameter (DS) of the drive shaft 26. As shown in FIG. 7, the difference between the maximum and minimum diameters of the through hole 40 becomes greater with increased diameter of the drive shaft 26. However, if the difference between the maximum and minimum diameters of the through hole 40 is equal to or greater than 1.2 mm, there are problems of noise generation and durability reduction due to an increased clearance between the through hole 40 and the outer surface of the drive shaft 26. If the difference between the maximum and minimum diameters of the through hole 40 is equal to or less than 1.4 mm, the swash plate 28 is likely to break by an impact from the drive shaft 26 during rotation due to a narrow clearance between the drive shaft 26 and the through hole 40. According to the present invention, the difference between the maximum and minimum diameters of the through hole 40 is determined in the range of 0.5–1.0 mm by considering generation of noise and the impact of the drive shaft 26.

Figure 1:
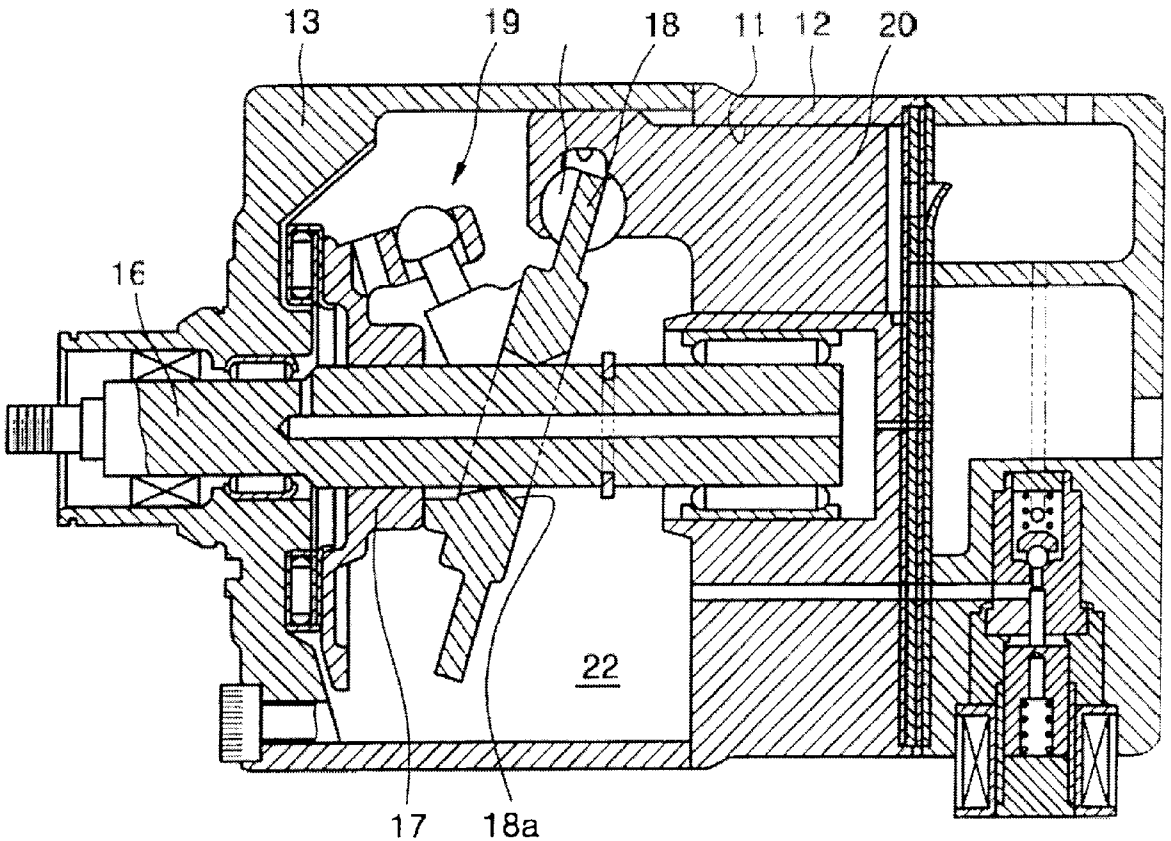
PRIOR ART FIG 1
FIG. 1 is a sectional view of a conventional variable capacity swash plate type compressor.
Figure 2:
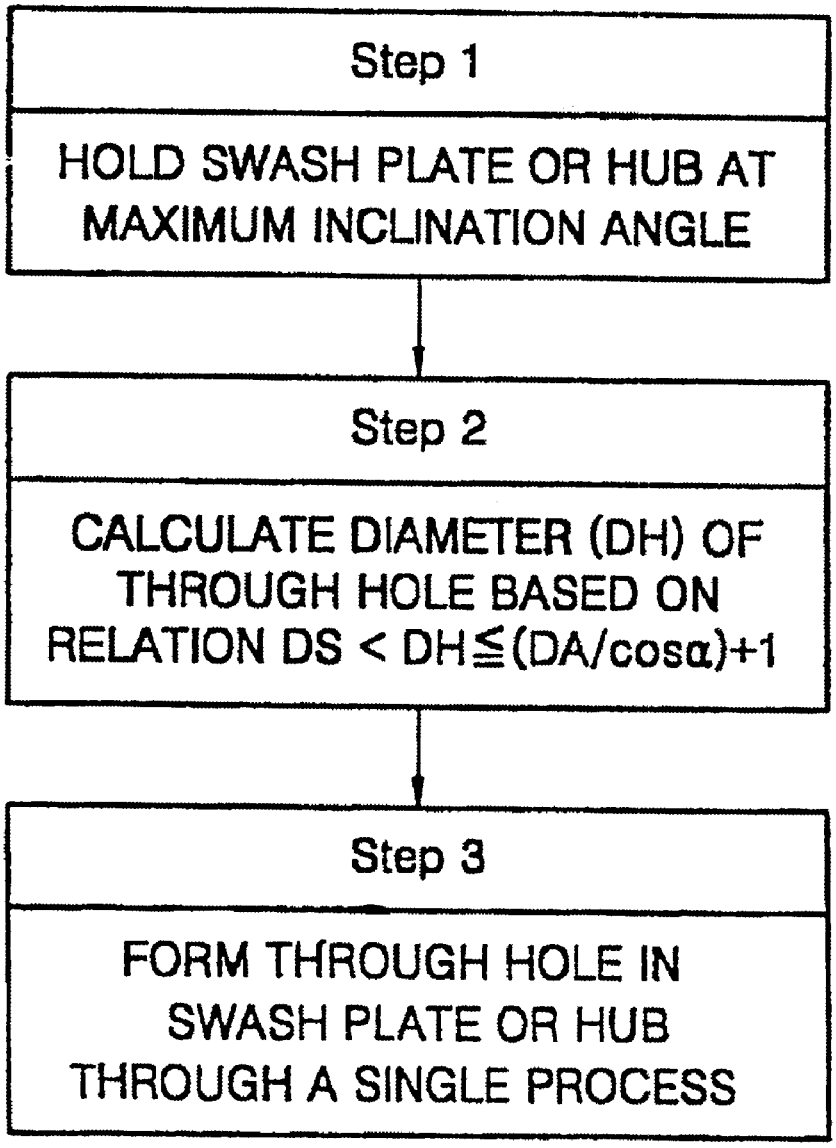
FIG. 2 is a flowchart illustrating a method for manufacturing a swash plate according to the present invention.
Figure 3:
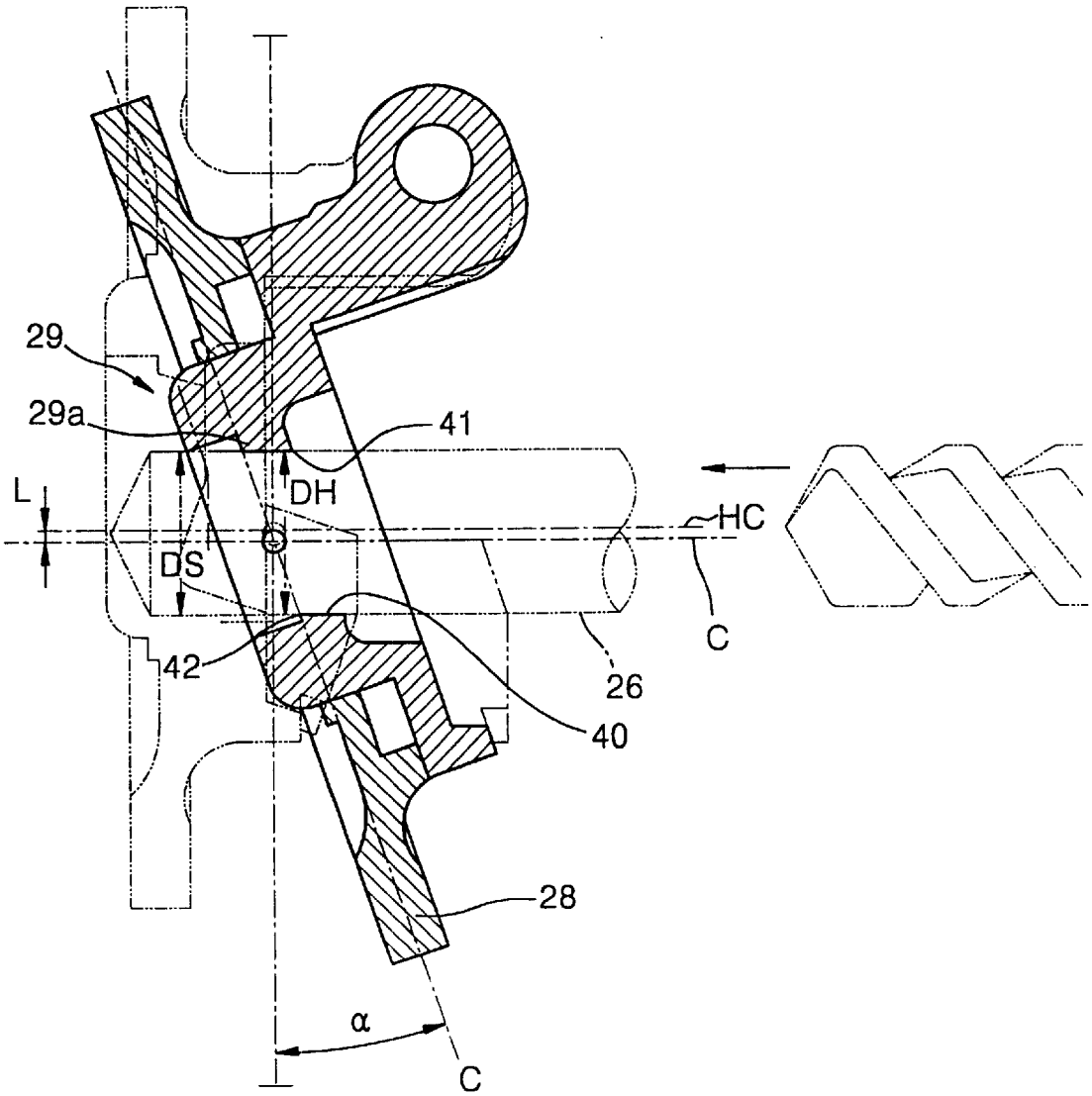
FIGS. 3 and 4 are diagrams illustrating the method for manufacturing the swash plate according to the present invention.
Figure 4:
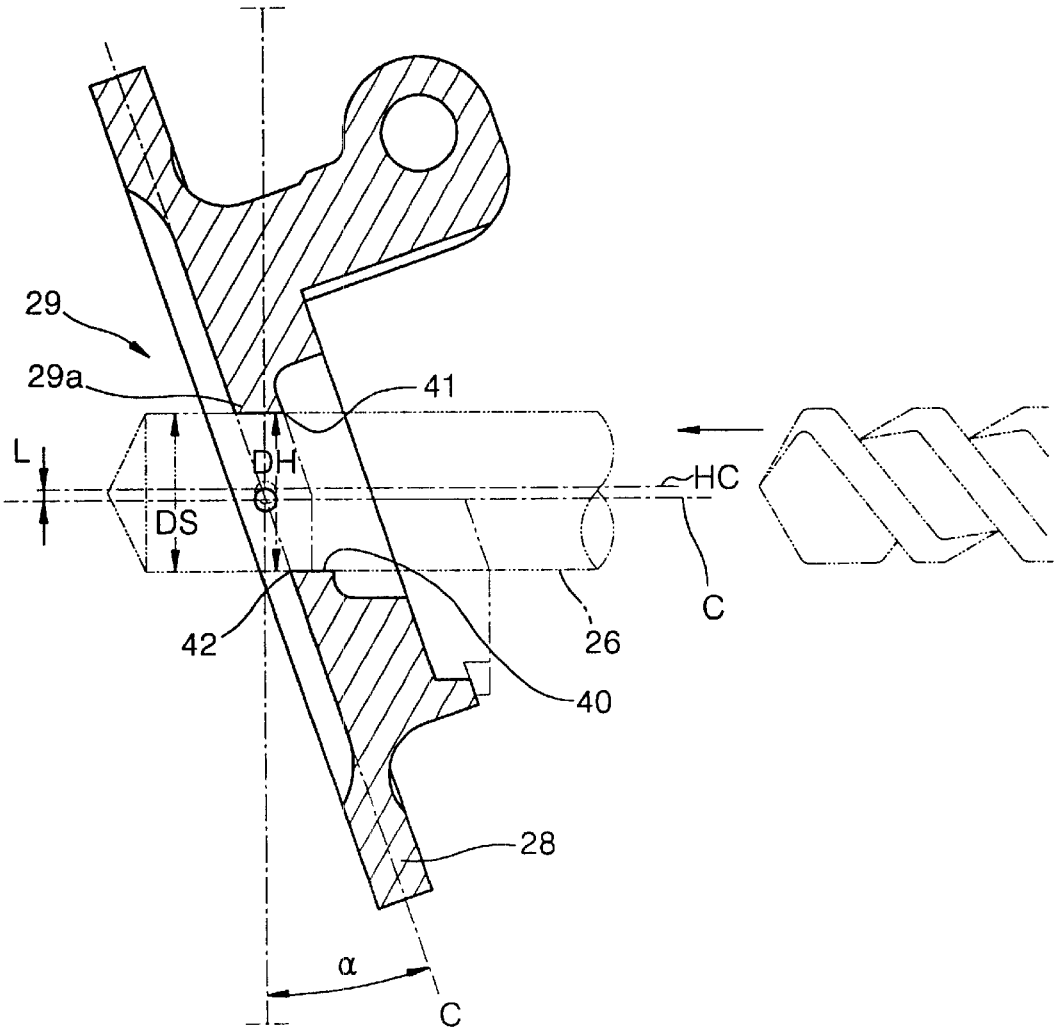
Figure 8:
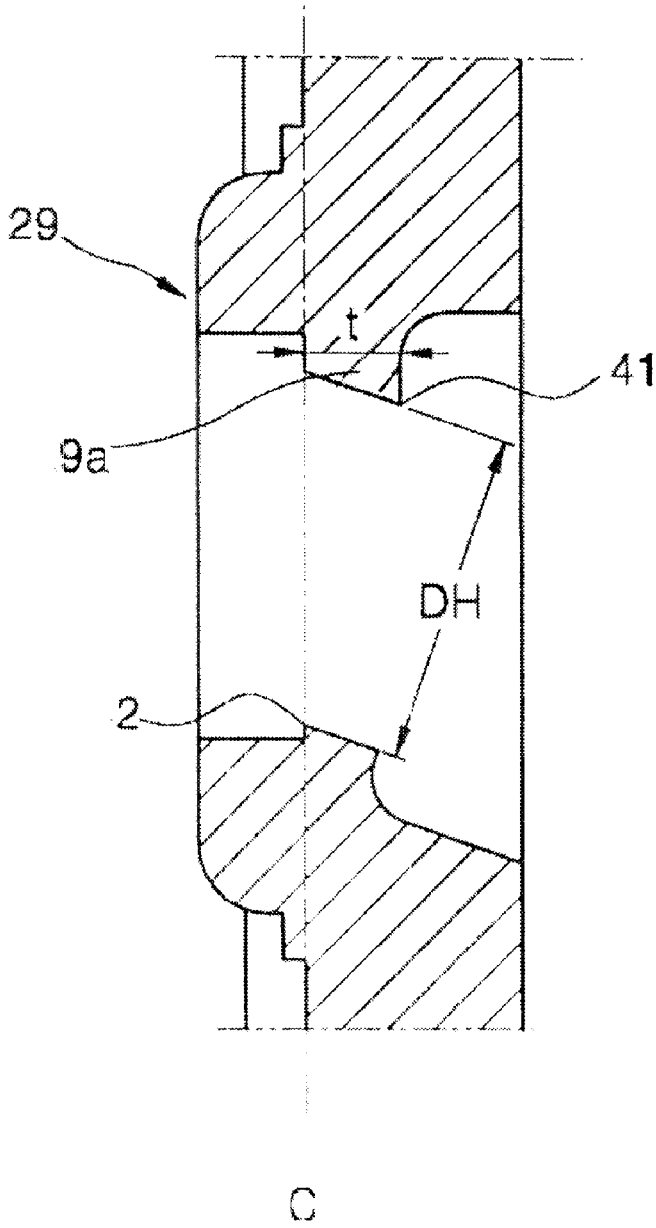
FIG. 8 is a magnified view of a boss.

In FIGS. 3, 4, and 8, reference number 29*a* denotes a boss of the swash plate 28 or the hub 29, which is a portion formed by the through hole 40 and is near the drive shaft 26, so it may interfere with the drive shaft 26. As shown in FIGS. 3, 4, and 8, the boss 29*a* is formed close to a clutch, i.e., the rotor of the compressor, based on the center "C" of the width of the swash plate 26. In calculating the diameter of the through hole 40 in Step 2, the thickness of the boss 29*a* may be calculated.

The thickness of the boss 29*a* is determined by the following relation by considering offset of the centroid of the rotating swash plate 28 and a correlation between the drive shaft 26 and the inner surface of the through hole 40: $t \leqq 2(a-r)/\tan\alpha$, where t is the thickness of the boss 29*a*, a is the major axis in millimeters of the elliptical openings of the through hole 40, and r is the radius in millimeters of the drive shaft 26. As shown in FIGS. 3 and 4, the thickness of the boss 29*a* is formed to be smaller than or substantially equal to the width of the swash plate 28 or the hub 29 by considering structural strength, designing condition, etc.

Once the diameter DH of the through hole 40 is determined based on the relation above in Step 2, the through hole 40 is made in the swash plate 28 or the hub 26 through a single process using a drill or a reamer, which is performed in a direction parallel to the horizontal axis HC while the swash plate 28 is in the maximum inclination angle position (Step 3).

In forming the through hole 40 in the swash plate 28 or the hub 26, the location of the through hole 40 is offset a predetermined distance "L" ("offset distance") above the centroid of the swash plate 28. This is because the centroid of the swash plate 28 is shifted above as it rotates with the drive shaft 26 while being hinged to the rotor fixedly mounted on the drive shaft 26. The offset distance L is preferably equal to the difference between the radius (DH/2) of the through hole 40 and the radius (DS/2) of the drive shaft 26.

The diameter DH of the through hole 40 was calculated using the relation above by varying the diameter DS of the drive shaft 26 and the inclination angle of the swash plate 28. The results are shown in Tables 1 and 2.

TABLE 1

| Diameter of Drive Shaft (mm) | Inclination Angle of Swash Plate (°) | Diameter Through of Hole (mm) | Clearance between Through Hole and Drive Shaft (mm) |
|---|---|---|---|
| 14.0 | 16.0 | 14.6 | 0.28 |
| 15.0 | | 15.6 | 0.30 |
| 16.0 | | 16.6 | 0.32 |
| 17.0 | | 17.7 | 0.34 |
| 18.0 | | 18.7 | 0.36 |
| 19.0 | | 19.8 | 0.38 |
| 20.0 | | 20.8 | 0.40 |
| 21.0 | | 21.8 | 0.42 |

TABLE 2

| Diameter of Drive Shaft (mm) | Inclination Angle of Swash Plate (°) | Diameter of Through Hole (mm) | Clearance between Through Hole and Drive Shaft (mm) |
|---|---|---|---|
| 16.0 | 16.0 | 16.6 | 0.32 |
| | 17.0 | 16.7 | 0.37 |
| | 18.0 | 16.8 | 0.41 |
| | 19.0 | 16.9 | 0.46 |
| | 20.0 | 17.0 | 0.51 |
| | 21.0 | 17.1 | 0.57 |
| | 22.0 | 17.3 | 0.63 |

As shown in Tables 1 and 2, when the diameter of the through hole 40 is calculated using the relation above, the clearance between the drive shaft 26 and the through hole 40 is maintained without great variations.

Figure 5:
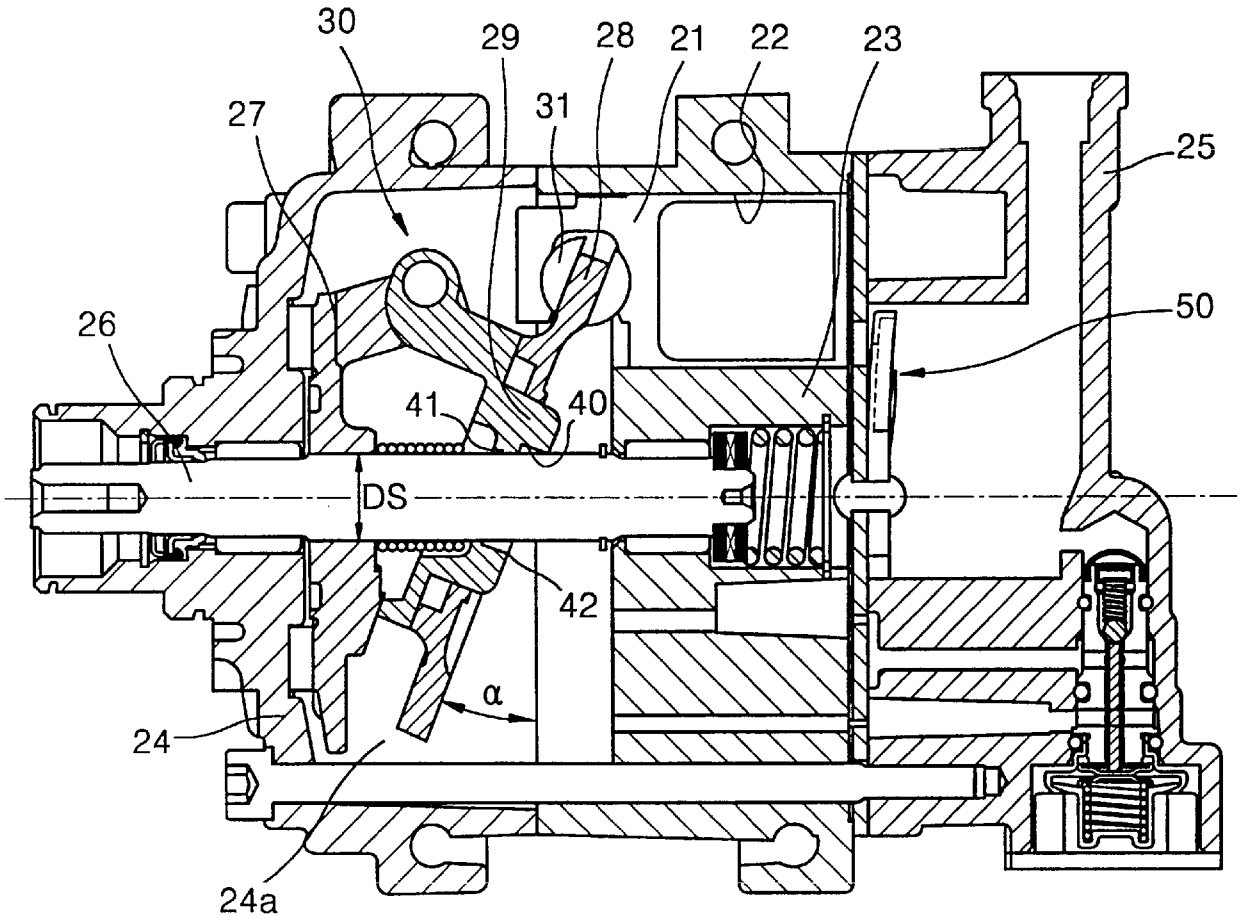
FIG. 5 is a sectional view of a variable capacity swash plate type compressor according to the present invention.

FIG. 5 shows a preferred embodiment of a variable capacity swash plate type compressor employing the swash plate manufactured by the method described above. As shown in FIG. 5, the variable capacity swash plate type compressor includes a cylinder block 23 provided with a plurality of bores 22 in which a plurality of pistons 21 are reciprocally disposed, front and rear housings 24 and 25 combined with the cylinder block 23 therebetween to form a crank chamber 24*a* and suction and discharge chambers, and a drive shaft 26 rotatably supported by the front and rear housings 24 and 25 and the cylinder block 23. A valve assembly 50 including suction and discharge valves, which are controlled according to the reciprocal movement of the pistons 21, is mounted between the cylinder block 23 and the rear housing 25.

A rotor 27 fixedly mounted on and rotating along with the drive shaft 26, and a swash plate 28 for reciprocating the pistons 21 with various inclination angles with respect to the drive shaft 26 are mounted in the crank chamber 24 a. The rotor 27 is hinged to a hub 29 coupled to the swash plate 28 by a hinge unit 30. A boss 29*a* is formed as a result of forming a through hole 40 through which the drive shaft 26 can pass, in the hub 29. Alternatively, the hub 29 may be built in the swash plate 28. In this case, the through hole 40 is formed at the center of the swash plate 28.

The through hole 40 is formed by drilling or reaming one time the hub 29 or the swash plate 28 positioned at the maximum inclination angle with respect to the horizontal axis in a horizontal direction using a drill or a reamer to have a diameter calculated based on the relation described above such that the through hole 40 does not interfere with the swash plate 28 during rotation of the swash plate 28. The openings of the through hole 40 formed in the hub 29 are elliptical. It is preferable that the inner surface of the through hole 40 is cylindrical such that when the swash plate 28 is in the maximum inclination angle position, the boss 29*a* formed by the through hole 40 is parallel to the drive shaft 26 or at least one portion of the boss 29*a* contacts along the drive shaft 26, as shown in FIG. 6. When the swash plate 28 is inclined at the minimum angle with respect to the drive shaft 26, it is preferable that upper and lower edges 41 and 42 of the boss 29*a* contact the outer surface of the drive shaft 26 or have a separation gap of 0.4–1.2 mm from the same. The lower edge 42 of the boss 29*a* formed through the above process is at the center "C" of the width of the swash plate 28 or the hub 29.

For the variable capacity swash plate type compressor according to the present invention having the structure described above, as the drive shaft 26 rotates, the swash plate 28 hinged to the rotor 24 by the hinge unit 30 is rotated. The pistons 21 reciprocate in the bores 22 of the cylinder block 23 while being engaged with the swash plate 28 via semi-spherical shoes 31. As a result, a refrigerant gas is sucked into the bores 22 through the suction chamber of the rear housing 25 and a suction port of the valve assembly 50, and compressed into the discharge chamber through a discharge port of the valve assembly 50.

During the process above, if a cooling load of the air conditioner is increased, a pressure level of the suction chamber is increased because the amount of the refrigerant flowed into an evaporator increases and the refrigerant is fully changed into the vapor state, thereby relatively increasing a suction force. When the suction force is increased, flow of a compressed gas into the crank chamber 24*a* from the discharge chamber is blocked by a pressure adjusting means, thereby lowing the pressure level of the crank chamber 24*a*.

As the pressure level of the crank chamber 24*a* becomes low, a compression reaction force acting on the swash plate 28 in response to the suction force acting on the pistons 21 when they move from the top dead point to the bottom dead point is decreased. When the pistons 21 move from the bottom dead point to the top dead point, a suction reaction force in response to a compression force acting on the pistons 21 by the swash plate 28 is increased, thereby increasing the inclination angle of the swash plate 28.

Figure 9:
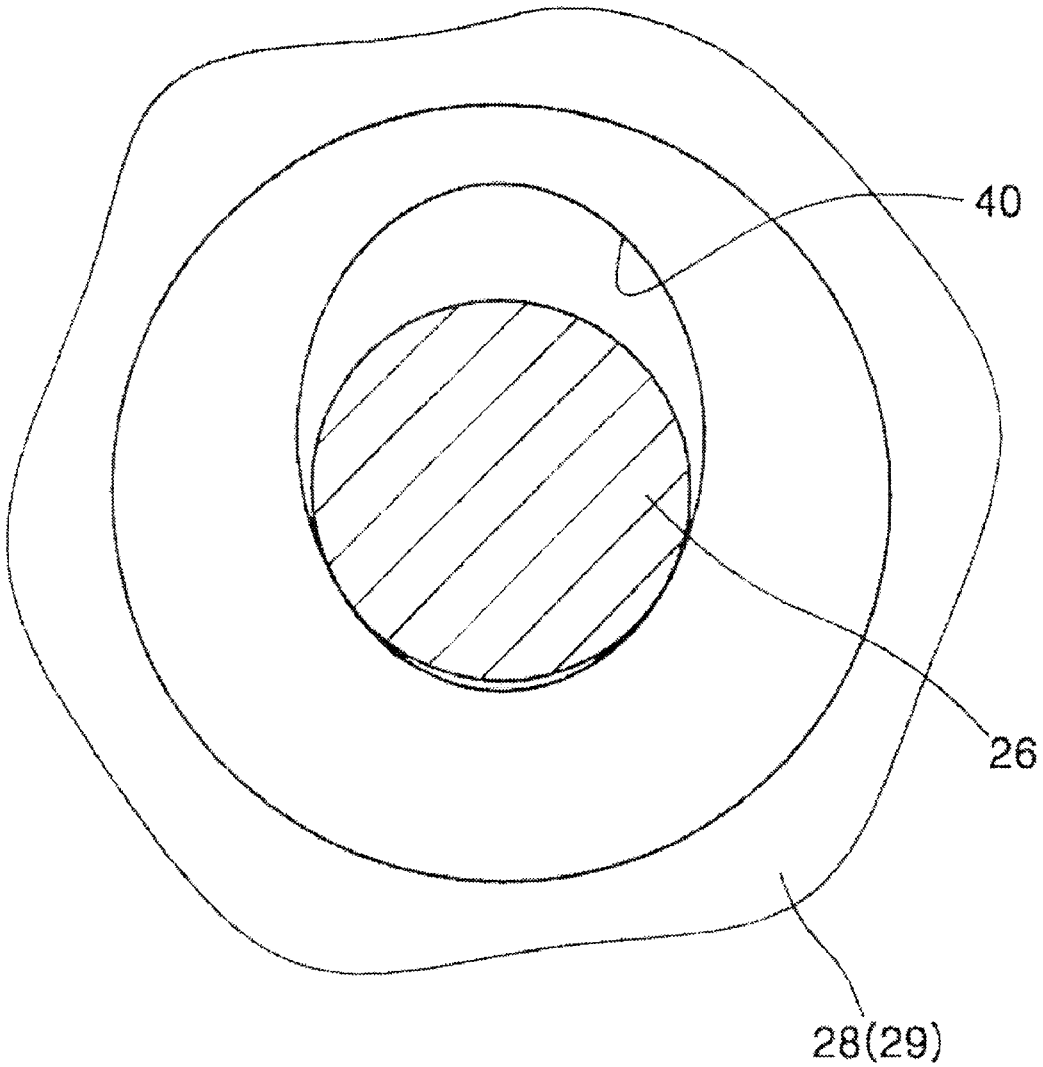
FIGS. 9 and 10 are a front view of the swash plate or the hub in a minimum inclination angle position in which the drive shaft disposed in the through hole is shown.
Figure 10:
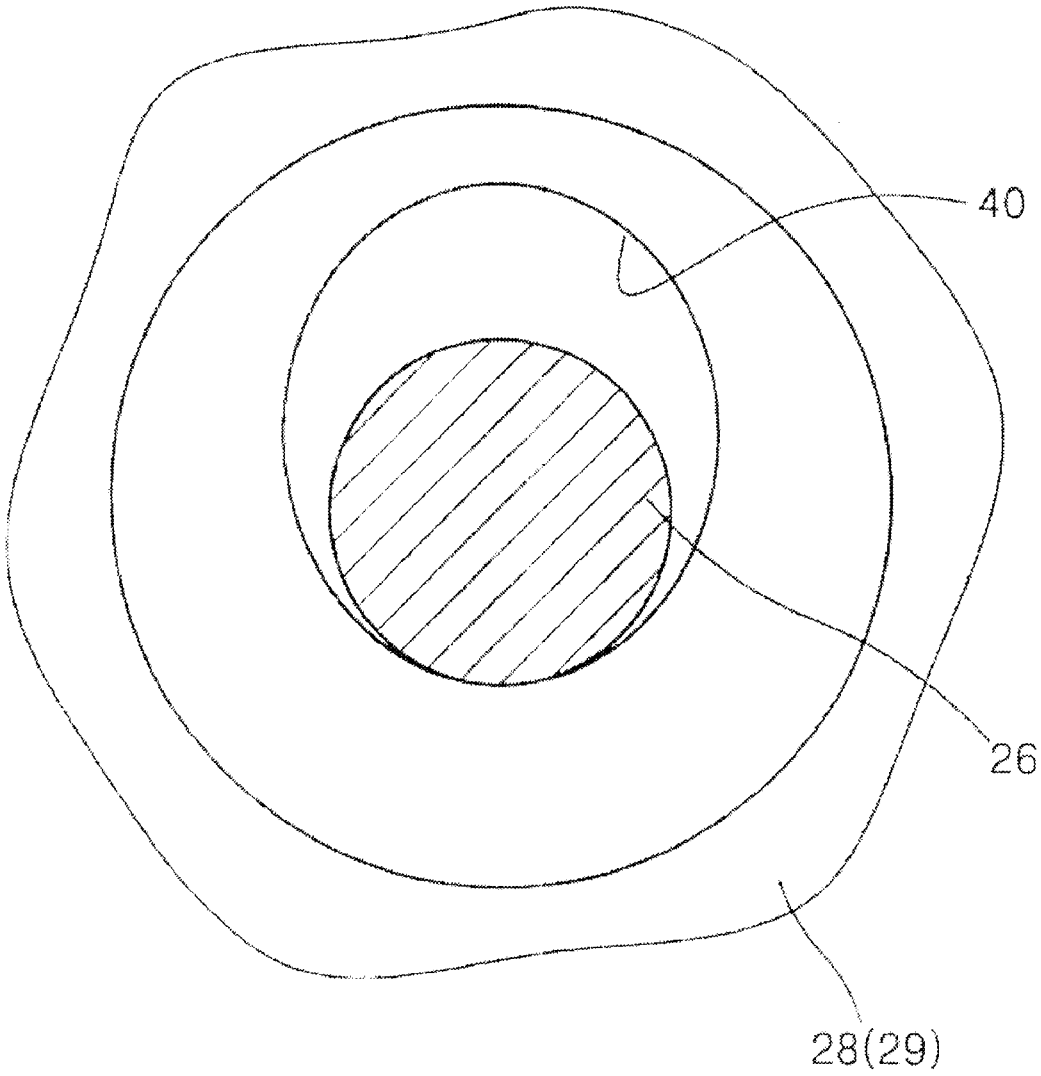

As the hub 26 and the swash plate 28 rotates along the drive shaft 26, the upper and lower edges 41 and 42 of the boss 29*a* become close to or contact the drive shaft 26 because the diameter of the through hole 40 is formed as small as possible by considering rotation of the swash plate 28, as described above. In particular, when the swash plate 28 is in the maximum inclination angle position, the outer circumference of the drive shaft 26 contacts along at least one lower portion of the through hole 40, as shown in FIG. 6, or keeps a separation gap of 0.4–1.2 mm from the through hole 40. When the swash plate 28 is in the minimum inclination angle position, due to a reduced clearance between the through hole 40 and the drive shaft 26, the outer surface of the drive shaft 26 contacts at least two side portions of the through hole 40, as shown in FIG. 9.

A problem of a serious vibration caused by a large clearance between the drive shaft 26 and the through hole

40, or interference between the drive shaft 26 and the through hole 40 which hinders smooth rotation of the swash plate 28 can be solved by the present invention.

As described above, in the swash plate manufacturing method and the variable capacity swash plate compressor adopting the swash plate according to the present invention, the through hole can be formed through a single process in the swash plate or the hub coupled to the swash plate, to have a diameter as small as possible, enabling the maximum angular displacement of the swash plate. The simple swash plate processing method improves productivity.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A variable capacity swash plate compressor comprising:

a cylinder block including a plurality of bores;

front and rear housings combined with each other with the cylinder block interposed therebetween to form a crank chamber and suction and discharge chambers;

a drive shaft rotatably supported by the front and rear housings;

a plurality of pistons reciprocatingly disposed in respective bores of the cylinder block;

a rotor fixedly mounted on the drive shaft and rotatable with the drive shaft in the crank chamber; and a swash plate or a hub having a boss defined by a through hole and hinged to the rotor for reciprocating the plurality of pistons, the through hole, through which the drive shaft passes, having a diameter DH satisfying the relation $DS<DH<(DS/\cos\alpha)+1.0$ mm, where DS is the diameter of the drive shaft in millimeters, and $\alpha$ is the maximum inclination angle of the swash plate.

2. The variable capacity swash plate compressor of claim 1, wherein the diameter DH satisfies the relation $DS<DH<(DS/\cos\alpha)+0.5$ mm.

3. The variable capacity swash plate compressor of claim 1, wherein the through hole is offset from the center of the swash plate or the hub.

4. The variable capacity swash plate compressor of claim 3, wherein the offset from the center of the swash plate or the hub is equal to a difference between a radius of the through hole and a radius of the drive shaft.

5. The variable capacity swash plate compressor of claim 1, wherein a thickness (t) of the boss of the swash plate or the hub satisfies the relation $t<2(a-r)/\tan\alpha$, where a is the major axis of elliptical openings of the through hole, and r is the radius of the drive shaft.

6. The variable capacity swash plate compressor of claim 1, wherein, when the swish plate is in a minimum inclination angle position, upper and lower edges of the boss closest to openings of the through hole contact the drive shaft.

7. The variable capacity swash plate compressor of claim 6, wherein the lower edge of the boss is located at the center of the width of the swash plate.

8. The variable capacity swash plate compressor of claim 1, wherein, when the swash plate is in a minimum inclination angle position, an inner surface of the through hole contacts an outer surface of the drive shaft at at least one point.

9. A method for manufacturing a swash plate or a hub having a boss defined by a through hole, the method comprising:

holding a swash plate or a hub in which a through hole is to be formed at a maximum inclination angle with respect to an horizontal axis;

calculating a diameter DH of the through hole using the relation $DS<DH<(DS/\cos\alpha)+1.0$ mm, where DS is the diameter in millimeters of a drive shaft to be mounted passing through the through hole, and $\alpha$ is the maximum inclination angle of the swash plate; and forming the through hole to have the diameter calculated through a single process on the swash plate or the hub in a maximum inclination angle position, producing the boss of the swash plate or the hub, the single process being carried out in a horizontal direction.

10. The method of claim 9, including forming the diameter DH of the through hole using the relation $DS<DH<(DS/\cos\alpha)+0.5$ mm.

11. The method of claim 10, including calculating a thickness (t) of the boss of the swash plate or the hub using the relation $t<2(a-r)/\tan\alpha$, where a is the major axis of elliptical openings of the through hole, and r is the radius of the drive shaft.

12. The method of claim 9, including forming the through hole in a portion offset from a center of the swash plate or the hub.

13. The method of claim 12, wherein the through hole is offset from the center of the swash plate or the hub by a difference between a radius of the through hole and a radius of the drive shaft.

* * * * *